US008668305B2

(12) United States Patent
Achatz et al.

(10) Patent No.: US 8,668,305 B2
(45) Date of Patent: Mar. 11, 2014

(54) PRINT GROUP FOR AN INKJET PRINTING APPARATUS

(75) Inventors: Augustinus Achatz, Ebersberg (DE); Andreas Mueller, Baldham (DE); Robert Sigismund, Putzbrunn (DE); Sebastian Wachter, Munich (DE)

(73) Assignee: Océ Printing Systems GmbH, Poing (DE)

( * ) Notice: Subject to any disclaimer, the term of this patent is extended or adjusted under 35 U.S.C. 154(b) by 86 days.

(21) Appl. No.: 13/237,278

(22) Filed: Sep. 20, 2011

(65) Prior Publication Data

US 2012/0147092 A1 Jun. 14, 2012

(30) Foreign Application Priority Data

Sep. 28, 2010 (DE) ..... 10 2010 037 829

(51) Int. Cl.
*B41J 2/165* (2006.01)
*B41J 2/155* (2006.01)

(52) U.S. Cl.
CPC ..... *B41J 2/16588* (2013.01); *B41J 2/16505* (2013.01); *B41J 2/155* (2013.01)
USPC ..... 347/29; 347/37; 347/42

(58) Field of Classification Search
CPC ..... B41J 2/1688
USPC ..... 347/29, 32
See application file for complete search history.

(56) References Cited

U.S. PATENT DOCUMENTS 5,363,132 A * 11/1994 Ikkatai ..... 347/29
2007/0109350 A1* 5/2007 Izawa et al. ..... 347/37
2011/0234663 A1* 9/2011 Ohhashi ..... 347/9

FOREIGN PATENT DOCUMENTS

JP 2009066909 A * 4/2009

* cited by examiner

*Primary Examiner* — Shelby Fidler
(74) *Attorney, Agent, or Firm* — Schiff Hardin LLP

(57) ABSTRACT

In a print group for an inkjet printing apparatus a printing unit is provided comprising a housing with print bars having print heads. A transport unit is provided for a printing substrate. Drive and guidance units are arranged per print bar which move the print bars independently of one another in a perpendicular direction from a printing position into a transport position and back. In a park unit racks are provided for protective cap bars. A protective cap bar is provided per print bar which when coupled to said print bar seals it. Print bars in an operating position not provided for printing are in the transport position and are coupled with associated protective cap bars. Print bars in said operating position for printing are in the printing position and their associated protective cap bars are arranged in the park unit racks.

7 Claims, 12 Drawing Sheets

PRINT GROUP FOR AN INKJET PRINTING APPARATUS

BACKGROUND

Inkjet printing apparatuses can be used for single or multicolor printing of a printing substrate, for example a single sheet or a belt-shaped recording material made of the most varied materials (paper, for example). The design of such inkjet printing apparatuses is known; see for example EP 0 788 882 B1. Inkjet printing apparatuses that operate according to the Drop-on-Demand (DoD) principle, for example, have as a printing unit a print head or multiple print heads with nozzles comprising ink channels, the activators of which nozzles—controlled by a printer controller—induce ink droplets in the direction of the printing substrate, which ink droplets are directed onto the printing substrate in order apply print dots there for a print image. The activators can generate ink droplets thermally (bubble jet) or piezoelectrically.

Given low print utilization of the inkjet printing apparatus, not all nozzles of the inkjet print heads are activated in the printing process; and many nozzles have idle time periods (print pauses), with the result that the ink in the ink channel of these nozzles is not moved. Due to the effect of the evaporation from the nozzle opening, the danger exists here that the viscosity of the ink then changes. This has the result that the ink in the ink channel can no longer move optimally, and for example cannot exit from the nozzle. In extreme cases, the ink in the ink channel dries completely and blocks the ink channel, such that a printing with this nozzle is no longer possible.

The drying of the ink in the nozzle can be prevented in that printing occurs from all nozzles within a predetermined cycle. This cycle can be adjusted corresponding to the print utilization. Individual points can thereby be applied in unprinted regions of the printing substrate, or print dot lines can be printed between print pages. In addition to unnecessary ink consumption and additional wear of the print heads, this method can lead to disruptions in the print image.

These problems in particular occur in color printers. Here, for example, print bars with print heads are arranged in a fixed position relative to one another as a printing unit. For example, print bars with five respective print heads can be provided, respectively one print bar for the colors black, cyan, magenta, yellow. Here the problem exists that one or more colors cannot be used, for example in black-and-white printing. Multiple cleaning cycles are then required in order to make the unused print heads run well again.

From U.S. Pat. No. 6,578,945 B2 it is known to avoid the drying out of the nozzles in an inkjet printing apparatus with multiple print heads in that the nozzles are closed with protective caps. The ink dispensed in the cleaning of the nozzles is thereby captured by the protective caps. In order to apply the protective caps onto the nozzles, the printing unit with the print heads is moved upward, away from the printing substrate; the protective caps are driven into the intervening space between printing unit and printing substrate; and thus the print heads are thereby cleaned. The protective caps are moved upward onto the print heads via an elastic force, wherein the print heads are covered. The protective cap unit remains in this position until the printing unit should be used again for printing.

In US 2007/0157962 A1, an inkjet printing apparatus is described in which the print head can be moved upward and perpendicular away from the printing substrate between a printing position and a position in which no printing is implemented. In this printing position a protective cap comprising rubber can be applied onto the nozzles of the print head.

From DE 10 2005 034 029 A1 an inkjet printing apparatus is known with multiple print heads arranged serially in the transport path of the printing substrate. The inkjet print heads successively print a resulting print image on the printing substrate. Individual inkjet print heads can be deactivated and shifted laterally (for example in order to service these) while the remaining print heads can continue printing.

DE 197 26 642 C1 describes a device to position an inkjet print head and a cleaning and sealing device. The inkjet print head can be pivoted from a printing position into a cleaning position and back again. A cleaning and sealing device can be moved onto the inkjet print head and away from this again. The cleaning and sealing device has a sealing cap and a wiping lip.

SUMMARY

It is an object to specify a print group for an inkjet printing apparatus, in which print group print bars comprising print heads and protective cap bars provided to seal the print bars can be positioned such that print bars that have a printing pause can be sealed with a protective cap bar while printing can take place with the remaining print bars.

In a print group for an inkjet printing apparatus a printing unit is provided comprising a housing with print bars having print heads. A transport unit is provided for a printing substrate. Drive and guidance units are arranged per print bar which move the print bars independently of one another in a perpendicular direction from a printing position into a transport position and back. Adjacent to the transport unit a park unit is provided, and in the park unit racks are provided for protective cap bars. A protective cap bar is provided per print bar which when coupled to said print bar seals it. Print bars in an operating position not provided for printing are in the transport position and are coupled with their associated protective cap bars. Print bars in said operating position and provided for printing are in the printing position and their associated protective cap bars are arranged in the racks of the park unit.

DESCRIPTION OF THE PREFERRED EMBODIMENT

Figure 1:
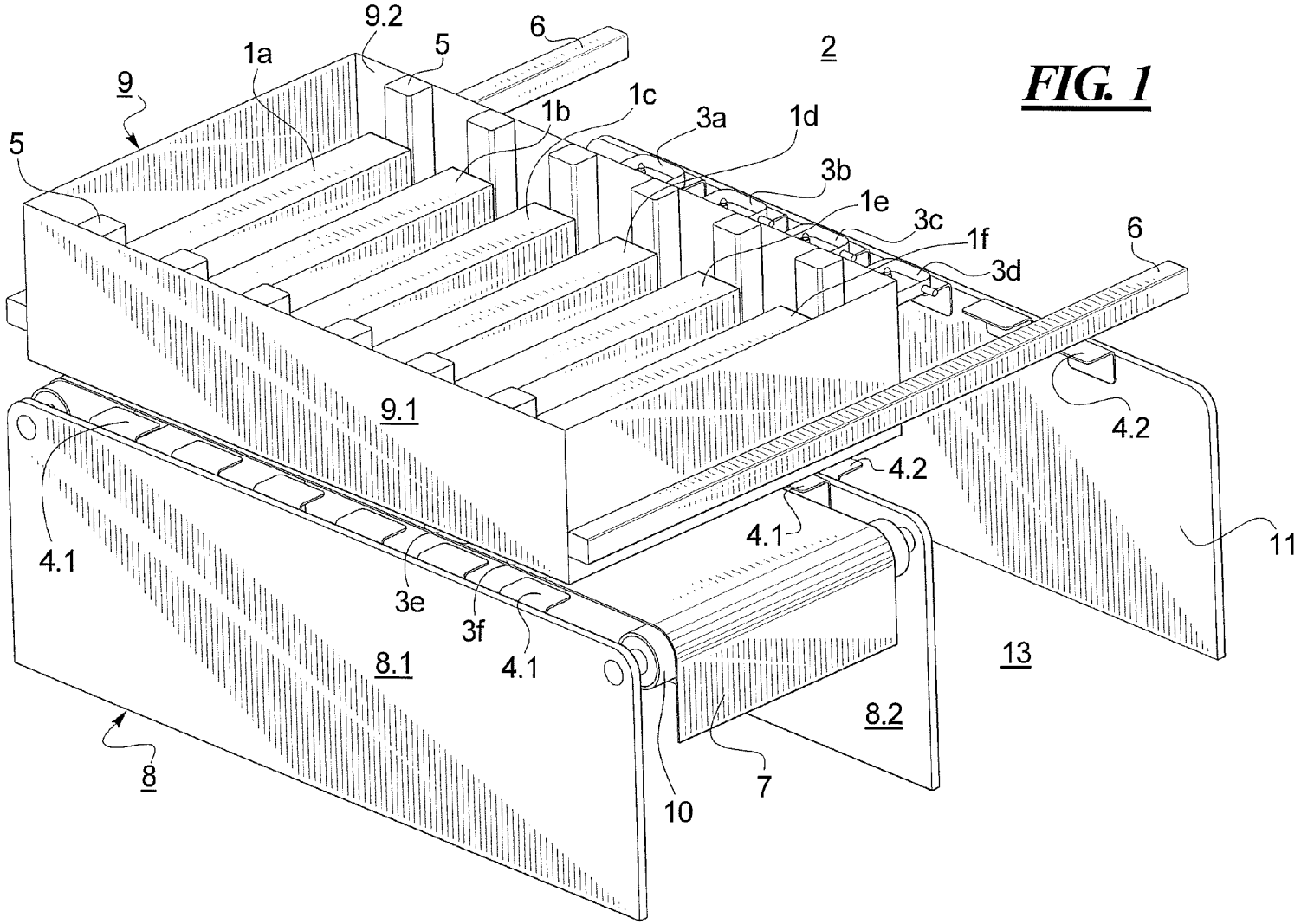
FIG. 1 is a principle, perspective presentation of a portion of a print group with a printing unit.

For the proposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated embodiment and such further applications of the principles of the invention as illustrated as would normally occur to one skilled in the art to which the invention relates are included.

In the print group according to the preferred embodiment, the print bars comprising print heads form a printing unit. In the printing unit the print bars can be moved independently of one another between a printing position (in which a printing substrate can be printed) and a transport position above the printing position. One protective cap bar is provided per print bar, which protective cap bar can be designed as a trough and can then seal all print heads of a print bar. It is also possible to execute the protective cap bar such that the protective cap bar respectively has one protective cap per print head. The print bars that are not used for printing are situated in the transport position and can be covered by their associated protective cap bars while the print bars used for printing are in the printing position, wherein the associated protective cap bars can be arranged outside of the printing unit.

Given the print group according to the preferred embodiment it is ensured that the following requirements for the position of the print bar with the print heads are satisfied:

- The print bars in the printing unit can adopt a printing position in which the print bars are positioned with the print heads over the printing substrate.
- The print bars in the printing unit can adopt a transport position in which the printing unit can be moved without damaging the print heads.
- The print bars can be placed on protective cap bars in a park position of the printing unit in order to avoid a drying out of the nozzles of the print heads during print pauses.
- The printing unit can adopt a maintenance position in which, for example, the print heads are accessible in order to be able to clean their nozzle surfaces.

The print group according to the preferred embodiment therefore has the following advantages:

- The print heads on the print bars cannot dry out given non-use since these print bars are respectively sealed tight with a protective cap bar.
- The previously unused print bars are immediately ready for use if necessary.
- Long reactivation periods and reactivation jobs are not necessary.
- The maintenance cost is significantly reduced since the unused print bars are protected against external influences, for example contamination or mechanical damage. Also, no additional ink is consumed and the wear of the print heads is reduced. The print quality is increased by reducing the background on the printing substrate.
- Each print bar is individually accessible or protected in each position via the use of the transportable protective cap bars, and can also be parked long-term. Additional, cost-intensive, individual positions that the print heads must take up are done away with.
- Nevertheless, the advantages of a complete unit relative to completely individualized print bars remain due to the integration of the print bars into a printing unit.

Figure 2:
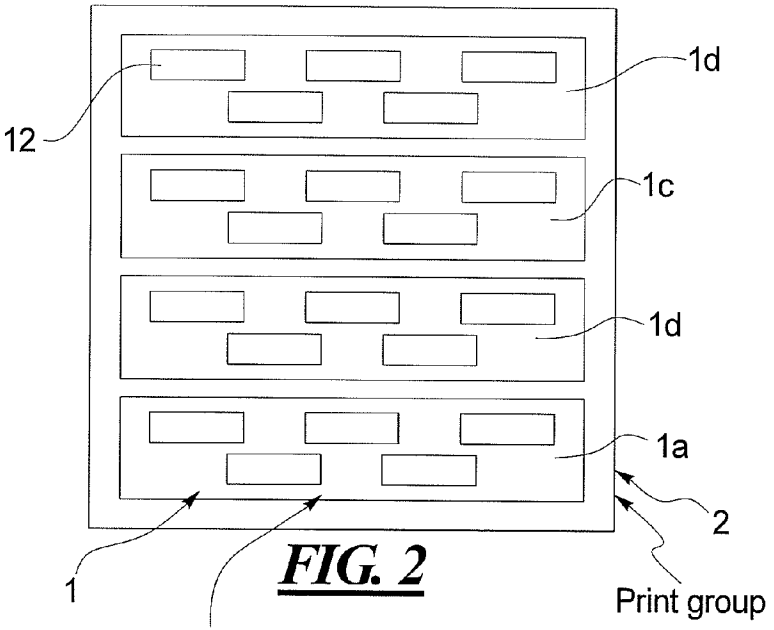
FIG. 2 is a principle presentation of a printing unit in which the print bars are entirely individualized.

The design of a print group with a printing unit 2 and a transport unit 8 for a printing substrate 7 results in principle from FIG. 1 for the purpose of explanation. The printing unit 2 comprises, for example, six print bars 1*a* through 1*f* that respectively provide print heads 12 (FIG. 2, 3). The printing unit 2 has a housing 9 with side walls 9.1 and 9.2 between which the print bars 1 are arranged. The side walls 9.1 and 9.2 of the housing 9 provide drive and guidance units 5 for the print bars 1 with which the print bars 1 can be moved independently of one another within the housing, perpendicular to the plane of the printing substrate 7. Furthermore, in the print group a drive and guidance unit 6 is provided that can be attached to the printing unit 2 and over which the printing unit 2 can be moved parallel to the plane of the printing substrate 7 within the print group. The printing unit 2 can be moved via the drive and guidance unit 6 from an operating position (in which the printing unit 2 is arranged above the printing substrate 7 to be printed) into a park position (that is situated next to the transport unit 8 for the printing substrate 7).

The transport unit 8 has side walls 8.1 and 8.2 between which transport rollers 10 for the printing substrate 7 are borne. Furthermore, racks 4.1 for protective cap bars 3 (called front cap rack 4.1) are arranged at the side walls 8.1 and 8.2 of the transport unit 8. The protective cap bars 3 are provided to seal print bars 1 that are not used in the printing. One protective cap bar 3 is respectively provided per print bar 1, wherein the protective cap bar 3 is designed as a trough for all print heads of an associated print bar 1. The protective cap bars 3 can respectively have an outflow for the ink collected in the trough (not shown in Figures). Furthermore, an additional side wall 11 is provided adjacent and parallel to the side walls 8.1 and 8.2 of the transport unit 8, which side wall 11—with the side wall 8.2 of the transport unit 8—forms a park unit 13 for the printing unit 2, wherein additional racks 4.2 for the protective cap bars 3 (called rear cap rack 4.2) are provided between the side wall 11 and the side wall 8.2 so that the protective cap bars 3 can be borne on the rear cap rack 4.2 in the park unit 13 in the park position. Four protective cap bars 3*a* through 3*d* are drawn as an example in the rear cab rack 4.2 in FIG. 1.

During operation, the printing unit 2 can assume two positions, wherein with the drive and guidance unit 6 the printing unit 2 can be moved from the one position into the other position and back:

- The printing unit 2 can be in the operating position in which the printing unit 2 is situated over the printing substrate 7. This case is shown in FIG. 1.
- The printing unit can be in the park position in which, in addition to the transport unit 8 for the printing substrate 7, the printing unit 2 is arranged in the park unit 13.

The print bars 1 in the printing unit 2 can likewise adopt two positions:

The print bars 1 can be in the printing position in which the print heads can print to the printing substrate 7. For example, in FIG. 1 the print bars 1*a* through 1*d* are in the printing position.

Via their drive and guidance unit 5 the print bars 1 can be brought upward into a transport position in which no printing is possible. In the transport position the printing unit 2, with the drive and guidance unit 6, can be moved parallel to the printing substrate 7 without the print heads of the print bar 1 being able to be damaged. For example, in FIG. 1 the print bars 1*e*, 1*f* are in the transport position.

In the park position in the park unit 13 the print bars 1 can be moved in their drive and guidance units 5 from the transport position into the park position, in which the print bars can be coupled with the protective cap bars 3. Counter to this they can likewise be brought from the park position into the transport position again, and in fact with or without protective cap bars 3.

The protective cap bars 3 can thereby be coupled with the associated print bars 1 in order to seal these, or they can be released by these. For this the protective cap bars 3 can selectively be borne in the front cap rack 4.1;

be borne in the rear cap rack 4.2;

be coupled with the associated print bars 1 in order to seal these.

In FIG. 1 the protective cap bars 3*a* through 3*d* are borne on the rear cap rack 4.2 while the protective cap bars 3*e* and 3*f* are coupled with the print bars 1*e* and 1*f* (not visible in FIG. 1).

FIG. 2 shows as an example a printing unit 2 with four print bars 1*a* through 1*d* with five respective print heads 12, wherein each print bar 1 can be operated independently of the others. Each print bar 1 can thus be moved independently of the other print bars 1 from the print position into the transport position and back, and thus can be brought from a printing position (in which the printing substrate 7 can be printed) into the transport position at a distance above the transport unit 8 for the printing substrate 7, in which transport position the printing unit 2 can be moved as a whole without damaging the print heads 12.

Figure 3:
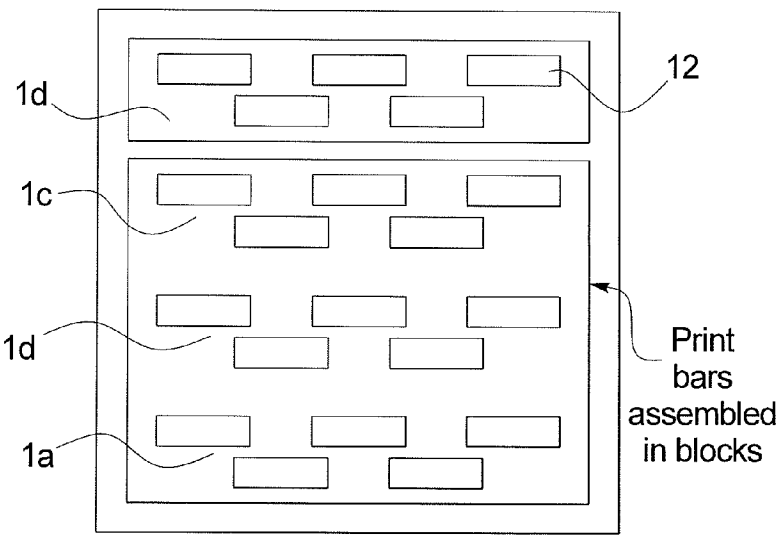
FIG. 3 is a principle presentation of a printing unit in which the print bars are partially individualized.

FIG. 3 shows as an example the printing unit 2 that, corresponding to FIG. 2, has print bars 1 with print heads 12. In contrast to FIG. 2, multiple print bars 1*a* through 1*c* have been assembled in the manner of a block in FIG. 3 and therefore can be moved together. In contrast to this, the print bar 1*d* can be operated individually.

The printing unit according to FIG. 1 is designed so that the print bars 1 can be operated both corresponding to FIG. 2 and corresponding to FIG. 3.

A printing unit according to FIGS. 1 through 3 can be used in color printing, for example. A print bar 1 can then respectively be provided whose print heads 12 generate print dots of one color, for example the colors black, cyan, magenta, yellow. The print heads 12 of the print bar 1 can thereby be arranged across the width of a printing substrate 7 in order to be able to print across its width.

Figure 4:
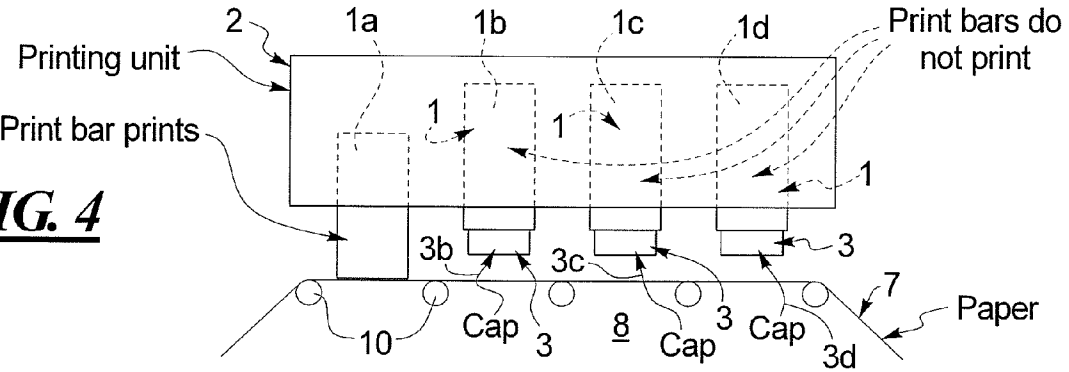
FIG. 4 is a principle presentation of a front view of the printing unit according to FIG. 1.

A principle image of the part of the print group according to FIG. 1 with the printing unit 2 and the transport unit 8 for the printing substrate 7 in a front view can be learned from FIG. 4. A print bar 1*a* is in the printing position; the other print bars 1*b* through 1*d* are drawn in the transport position. The print bars 1*b* through 1*d* in the transport position are respectively protected by a protective cap bar 3*b* through 3*d*, wherein each protective cap bar 3 seals one print bar 1.

Figure 5:
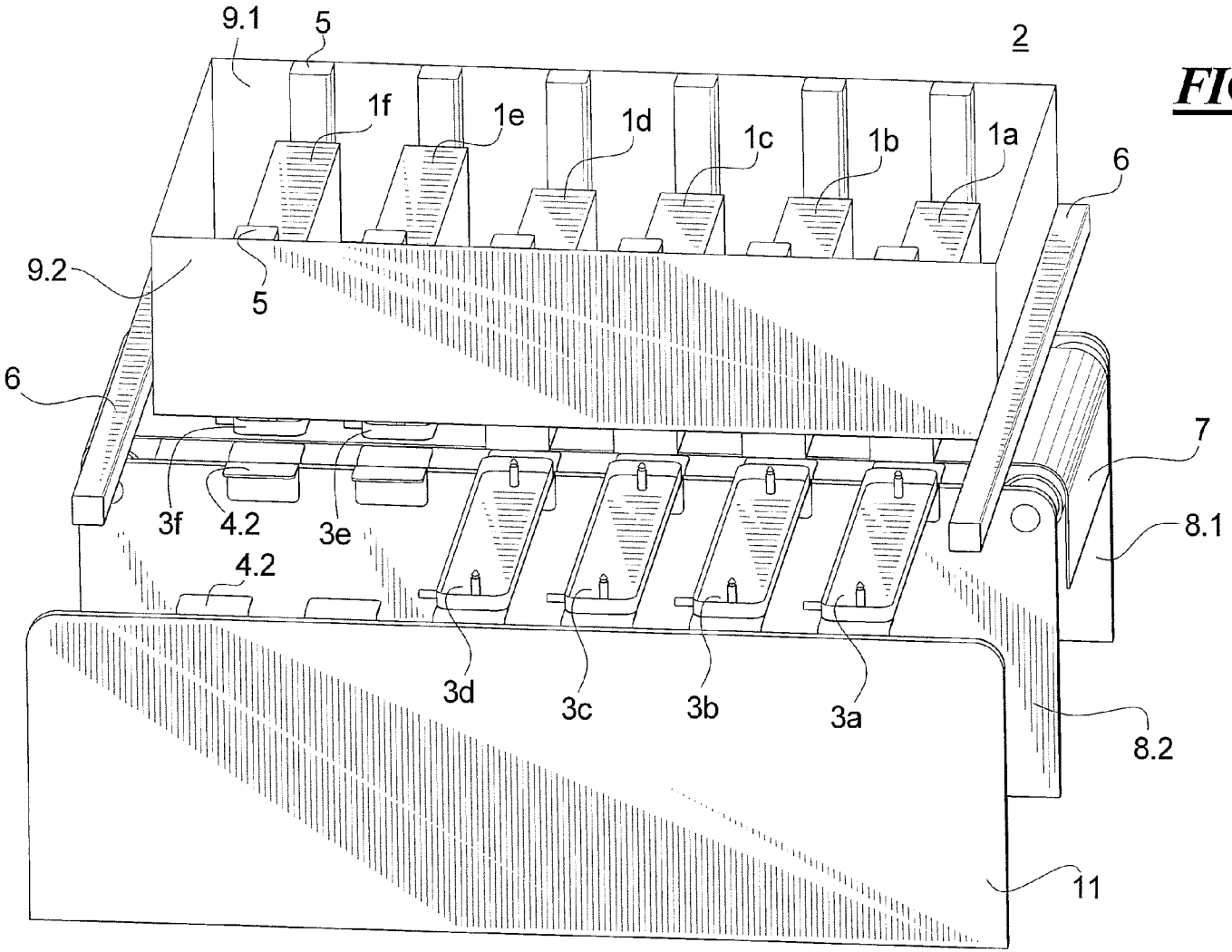
FIG. 5 is a principle, perspective presentation of the printing unit, in which the printing unit is in the operating position and individual print bars are in the printing position.

FIG. 5 shows the section of the print group in comparison to FIG. 1 from the opposite side. The printing unit 2 is in the operating position. Of the printing unit 2, the housing 9 with the side walls 9.1 and 9.2, the print bars 1*a* through 1*f* and the drive and guidance units 5 (one respectively per print bar 1*a* through 1*f*) are shown. Of the print bars 1*a* through 1*f*, the print bars 1*e*, 1*f* are covered with a protective cap bar 3*e*, 3*f*; these print bars 1*e*, 1*f* are situated in the transport position, above the printing position. The remaining print bars 1*a* through 1*d* are in the printing position, and in addition to the print bars 1*a* through 1*d* their protective cap bars 3*a* through 3*d* are parked on their racks 4.2 between the side wall 8.2 and the side wall 11 (rear cap rail 4.2). Printing can thus take place with the print bars 1*a* through 1*d* while the print bars 1*e*, 1*f* (that have a printing pause) are covered with a protective cap bar 3*e*, 3*f* so that the nozzles of the respective print heads do not dry out.

Figure 6:
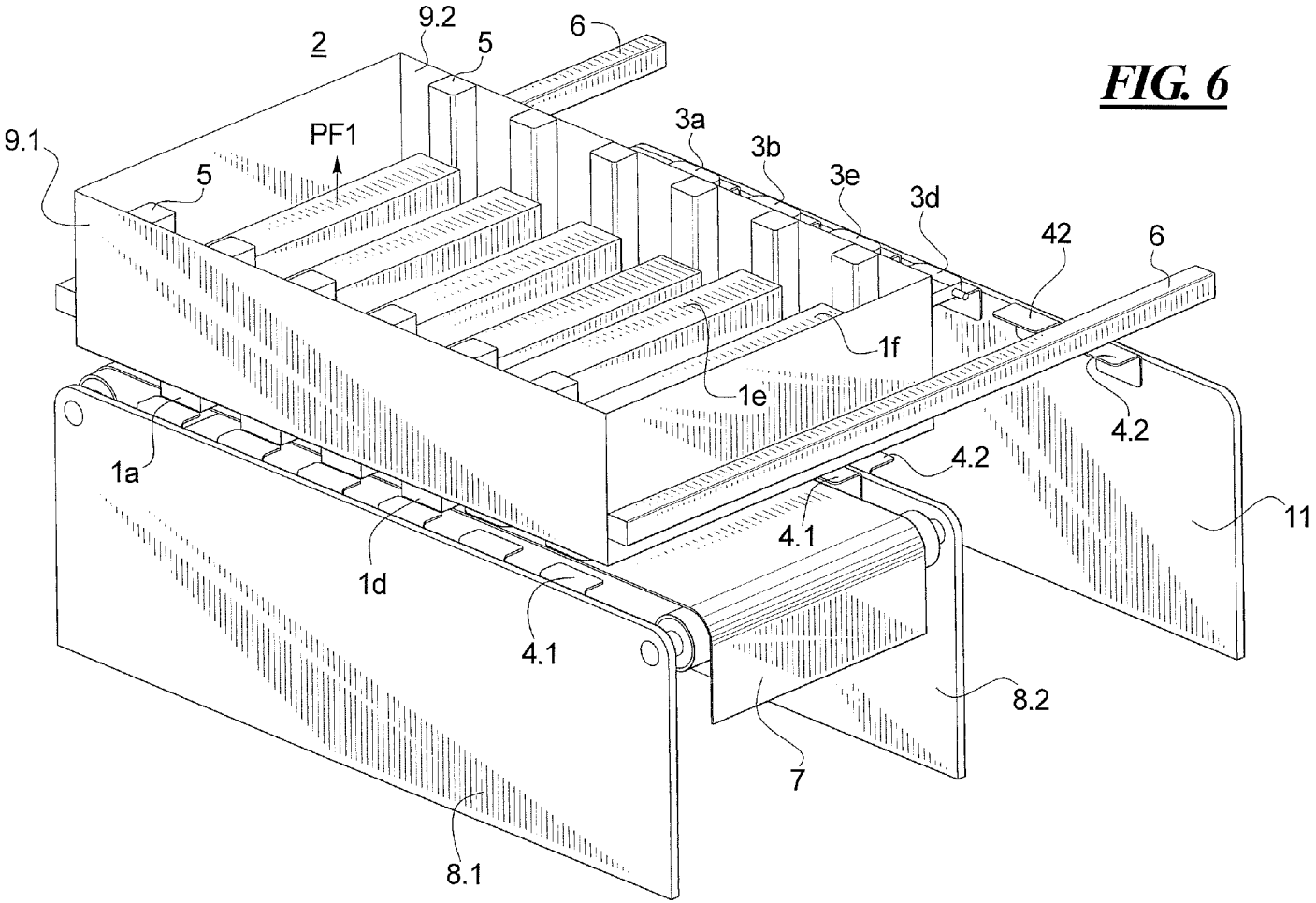
FIG. 6 is a principle, perspective presentation of the printing unit in the operating position when all print bars are in the transport position.

FIG. 6 shows the printing unit 2 in the operating position when the print bars 1*a* through 1*d* of the printing unit 2 have been moved upward (in the direction of the arrows PF1) from the printing position into the transport position. The attitude of the housing 9 for the print bars 1 thereby remains unchanged. Only the print bars 1*a* through 1*d* are moved upward from their drive and guidance units 5. The print bars 1*e*, 1*f* remain in the position of FIG. 5, and likewise the protective cap bars 3*e*, 3*f*. Four protective cap bars 3*a* through 3*d* are borne next to the transport unit 8 on the cap rack 4.2 in the park unit; and two protective cap bars 3*e*, 3*f* cover their print bars 1*e*, 1*f*.

Figure 7:
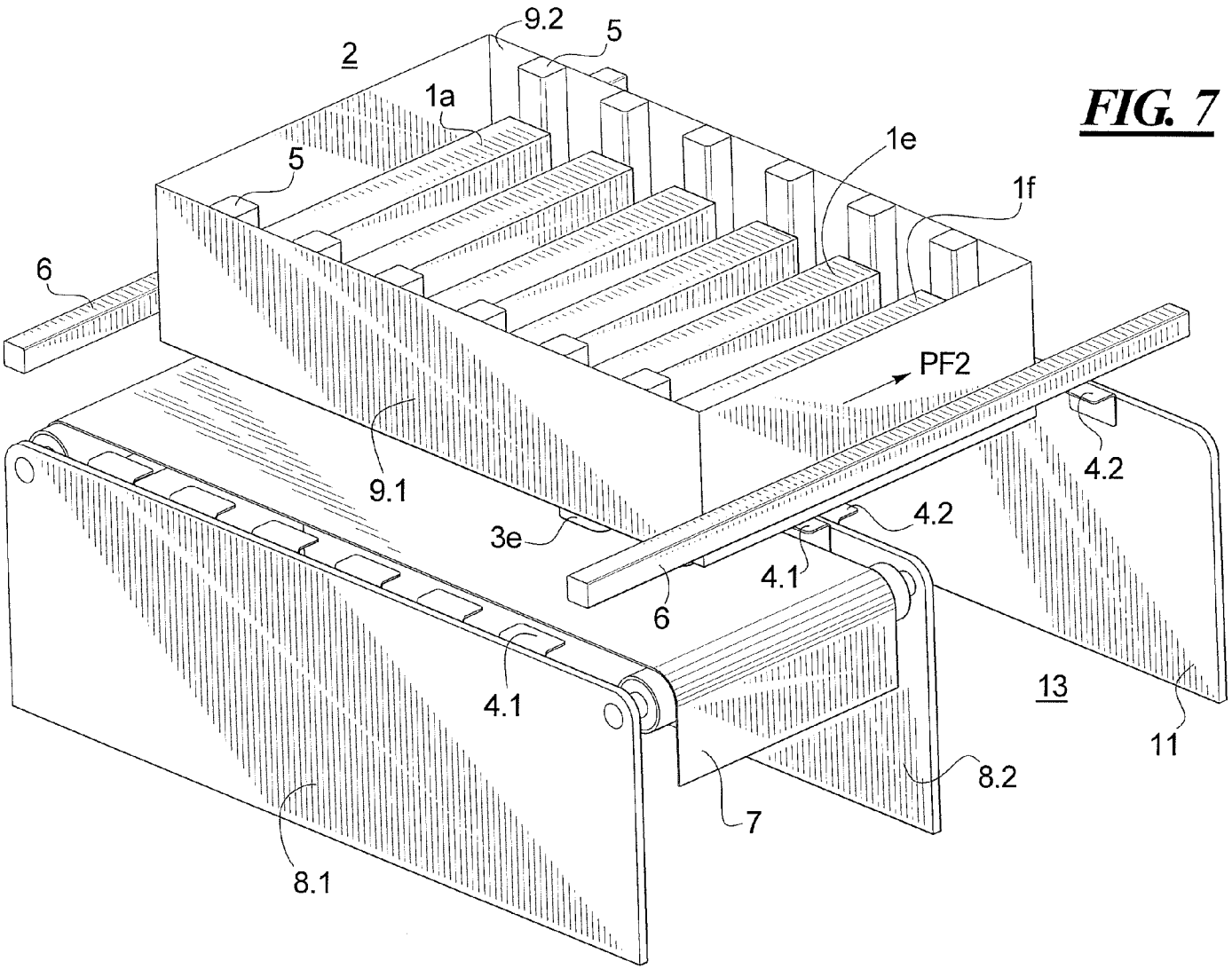
FIG. 7 is a principle, perspective presentation of the printing unit when the printing unit is moved into the park position.

FIG. 7 shows the print group when the printing unit 2 is driven from the operating position into the park position (Arrow PF2). The printing unit 2 is thereby moved in the direction of the arrow PF2 with the aid of the drive and guidance unit 6. In this operating position the print bars 1*a* through 1*f* are in the transport position. The transport unit 8 and the printing substrate 7 are thereby released. Only the print bars 1*e*, 1*f* are covered by their protective cap bars 3*e*, 3*f*.

Figure 8:
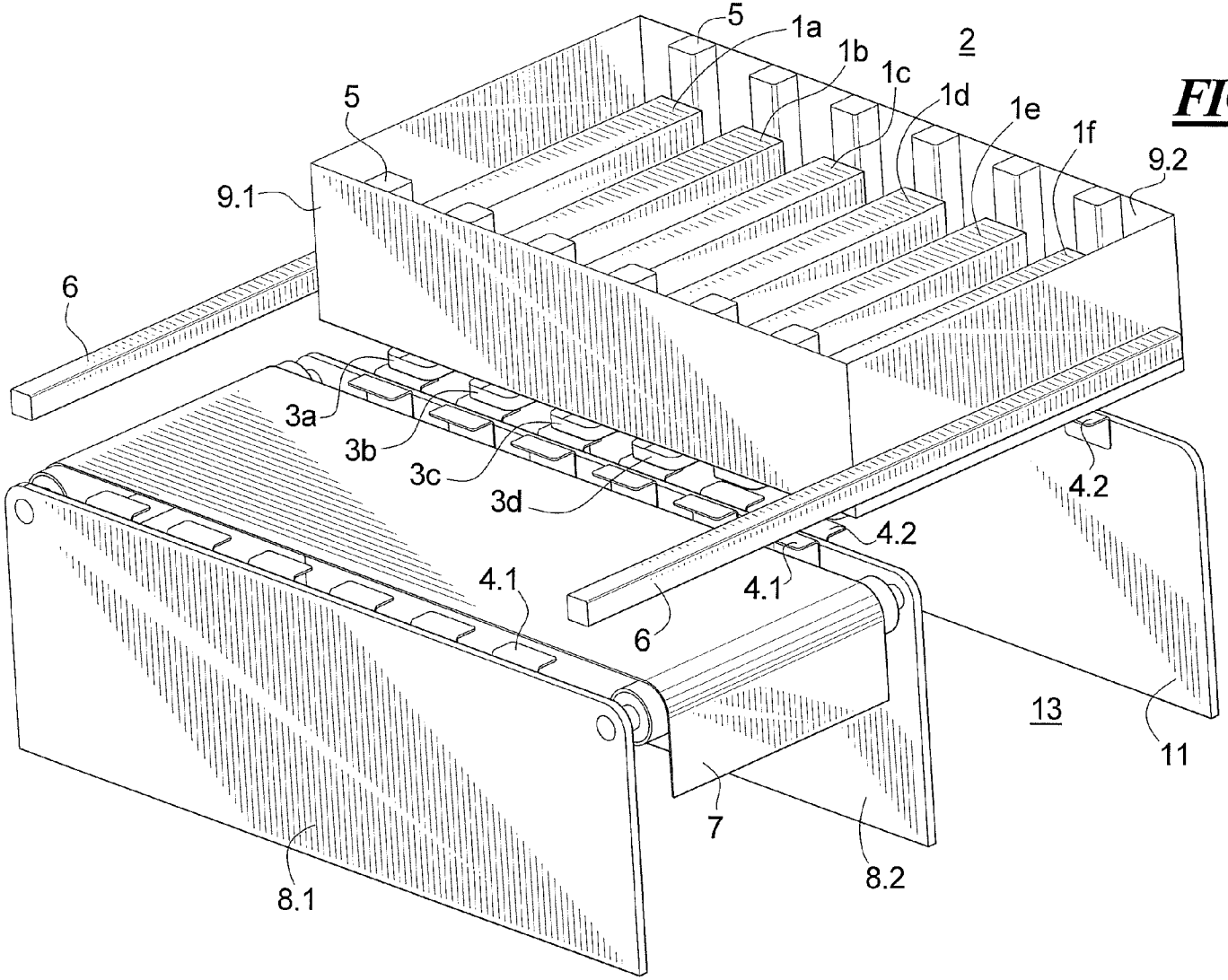
FIG. 8 is a principle, perspective presentation of the printing unit when the printing unit is in the park position.

FIG. 8 shows the case in which the printing unit 2 has reached the park position. The printing unit 2 now lies between the side wall 8.2 of the transport unit 8 and the side wall 11 of the park unit 13. The print bars 1*e*, 1*f* are thereby covered by their protective cap bars 3*e*, 3*f*; and the protective cap bars 3*a* through 3*d* for the print bars 1*a* through 1*d* are located in the park position on the rear rack 4.2.

Figure 9:
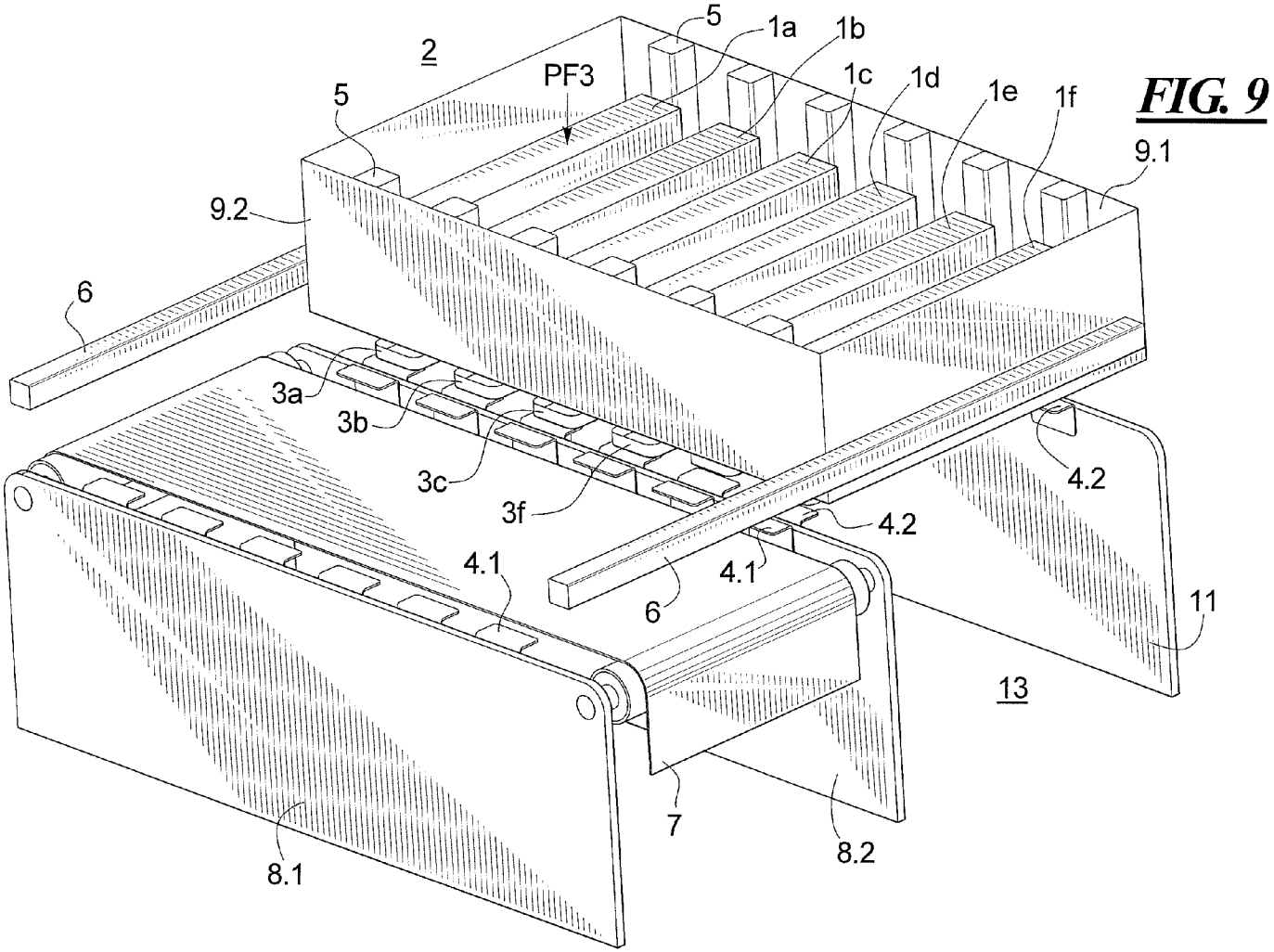
FIG. 9 is a principle, perspective presentation of the printing unit in the operating position when the printing unit is in the park position and the print bars are sealed by their protective cap bars.

In the park position of the printing unit 2 the print bars 1 can be moved downward in their guidance and drive units 5 in the direction of the arrow PF3 (FIG. 9), wherein the print bars 1 can be sealed with their protective cap bars 3. The protective cap bars 3 and print bars 1 can be connected with one another by a seal (not shown). In FIG. 9 the protective cap bars 3*a* through 3*d* are still situated in the rear cap rack 4.2; and the protective cap bars 3*e*, 3*f* are coupled to the print bars 1*e*, 1*f*. If the printing unit 2 has reached the park position, all print bars 1 are covered by their respective protective cap bars 3.

Figure 10:
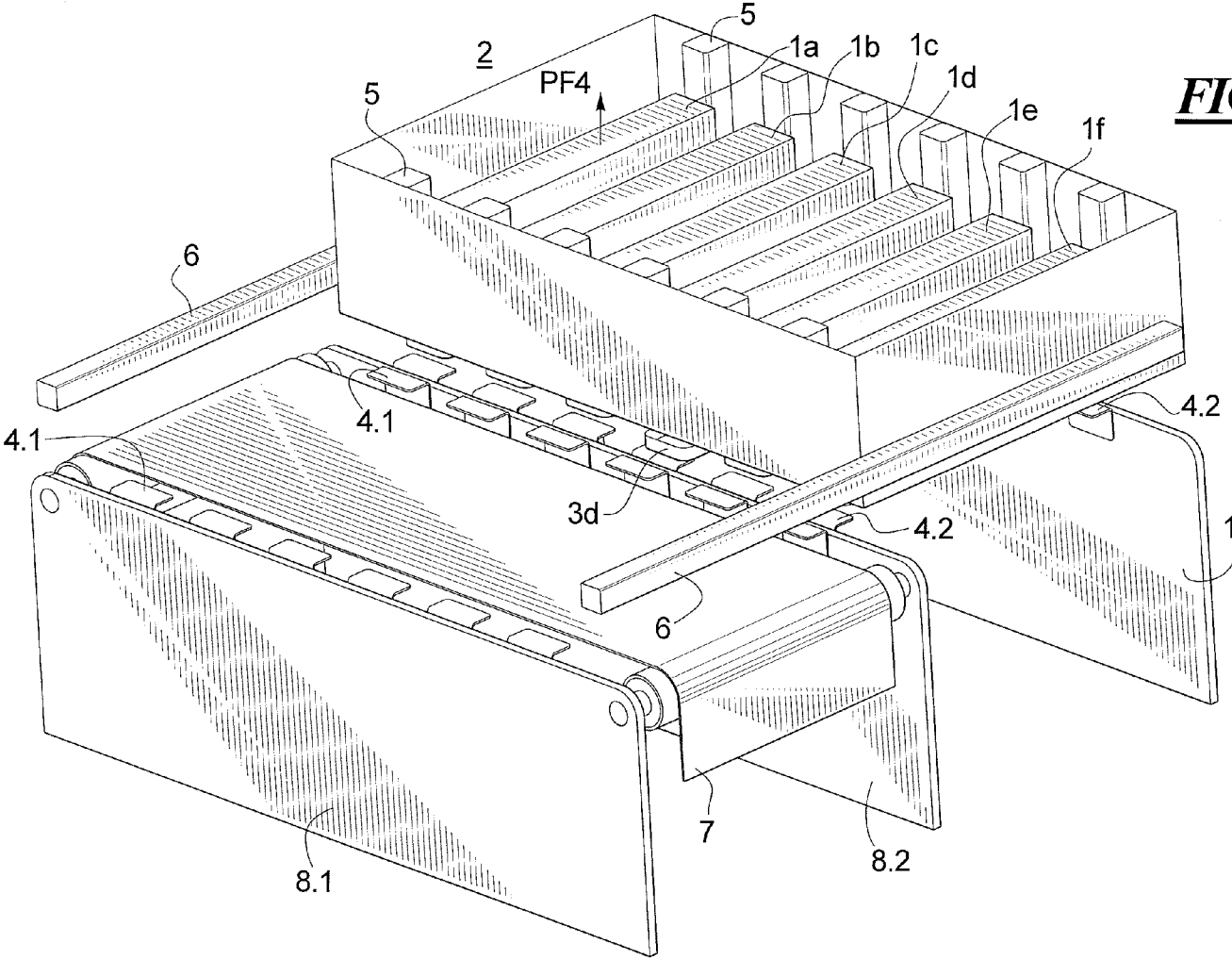
FIG. 10 is a principle, perspective presentation of the printing unit in the park position when the print bars are moved into the transport position.

If the printing unit 2 should be used again for printing, wherein the printing should only be conducted with the print bar 1*d*, for example, the print bars 1*a* through 1*c*, 1*e* through 1*f* that are not provided for the printing (together with coupled protective cap bars 3*a* through 3*c*, 3*e* through 3*f*; not visible in FIG. 10) are driven upward from the park position (arrow PF4) while the print bar 1*d* provided for the printing detaches from its protective cap bar 3*d* and is driven upward without this; and the protective cap bar 3*d* remains in the park position on its rack 4.2. FIG. 10 shows this case.

Figure 11:
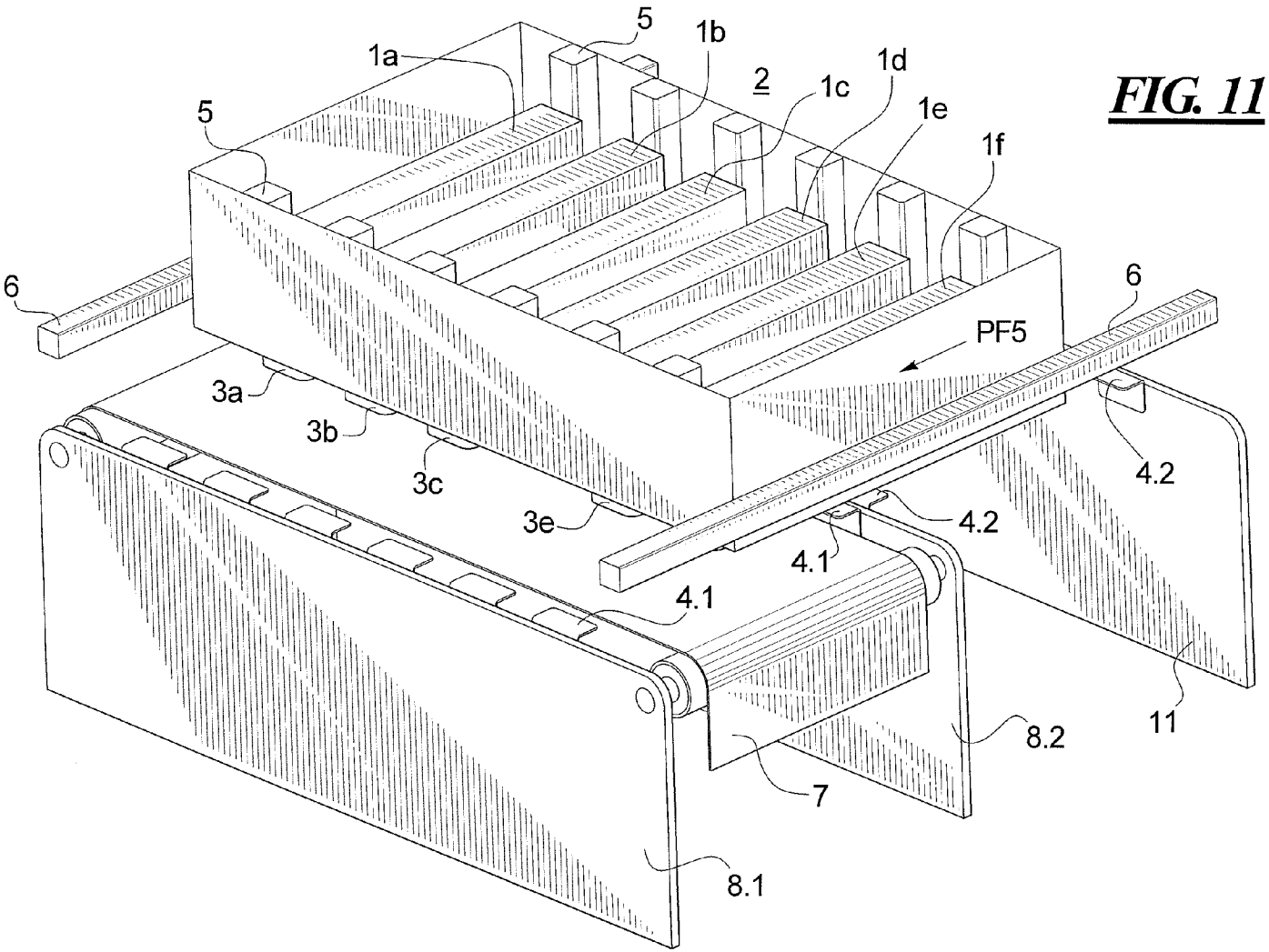
FIG. 11 is a principle, perspective presentation of the printing unit when the printing unit is moved from the park position to the operating position.

The printing unit 2 is finally moved with the aid of the drive and guidance unit 6 from the park position into the operating position, in the direction of the arrow PF5 (FIG. 11). The print bars 1 are moved into the transport position, wherein the print bars 1*a* through 1*c*, 1*e*, 1*f* are covered with their protective cap bars 3*a* through 3*c*, 3*e* through 3*f*. Only the print bar 1*d* is not protected by its protective cap bar 3*d*.

Figure 12:
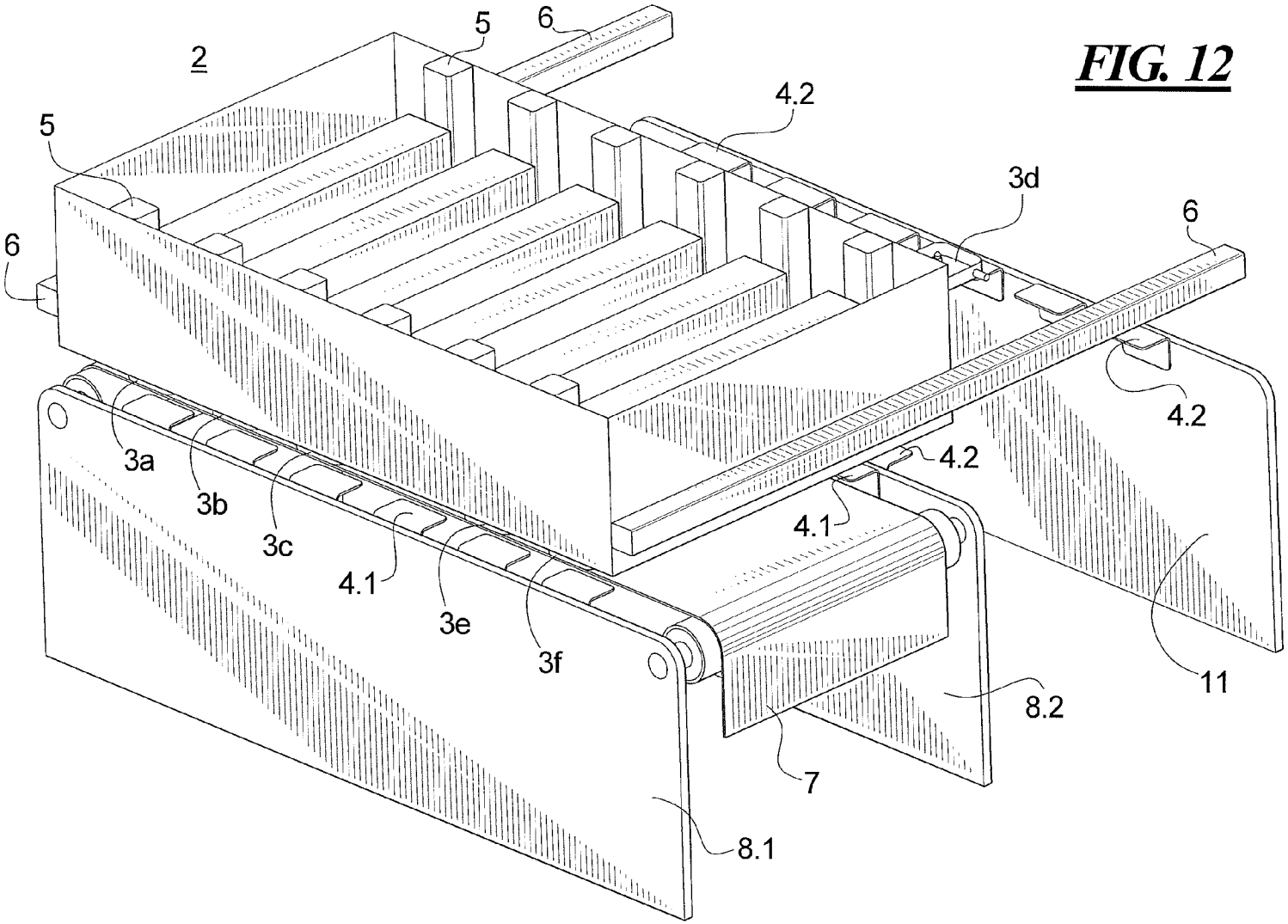
FIG. 12 is a principle, perspective presentation of the printing unit when the printing unit is in the operating position.
Figure 13:
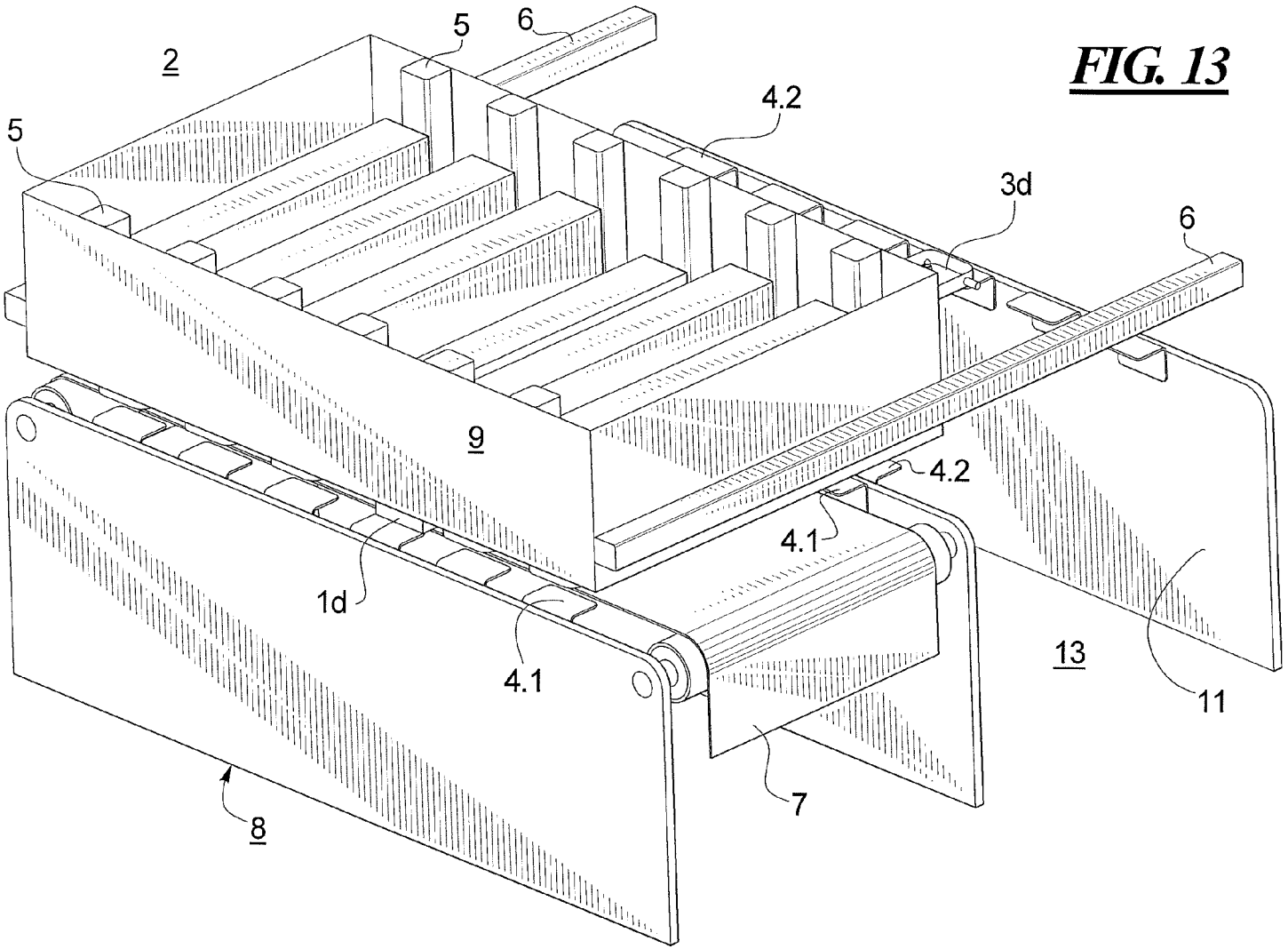
FIG. 13 is a principle, perspective presentation of the printing unit when the printing unit is in the operating position, one print bar is in the printing position and the remaining print bars are in the transport position, covered by their protective cap bars.

The operating position of the printing unit 2 is achieved in FIG. 12. The print bar 1*d* provided for printing can now be brought downward in its drive and guidance unit 5 into the printing position, wherein the print bars 1*a* through 1*c*, 1*e*, 1*f* that are not used for the printing remain in the transport position with coupled protective cap bars 3*a* through 3*c*, 3*e*, 3*f*. FIG. 13 shows this operating position. The protective cap 1*d* provided for the printing is in the printing position; the protective cap bar 3*d* for this print bar 1*d* lies in the rear cap rack 4.2. The remaining print bars 1*a* through 1*c*, 1*e*, 1*f* remain in the printing unit 2 in the transport position, wherein these print bars 1*a* through 1*c*, 1*e*, 1*f* are sealed by their protective cap bars 3*a* through 3*c*, 3*e*, 3*f*.

Figure 14:
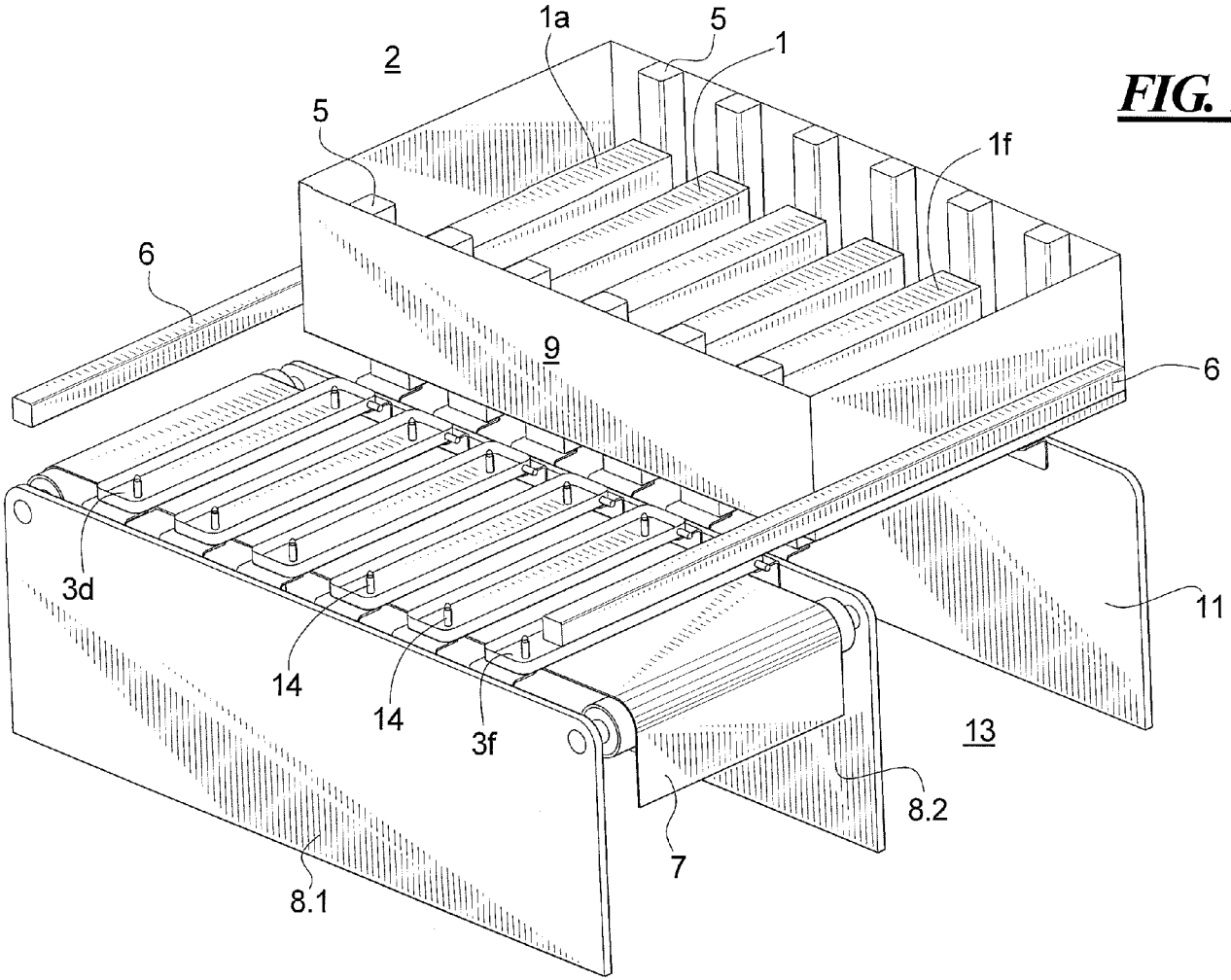
FIG. 14 is a principle, perspective presentation of the printing unit when the printing unit is in the service position.

Finally, the printing unit 2 can be brought into a service position (FIG. 14). In the service position the print bars 1 are freely accessible and can be cleaned, for example. For this the printing unit 2 is located in the park position, the print bars 1 are lowered into the park position; and they can additionally be moved further downward out of the housing 9 by their drive and guidance units 5. However, the protective cap bars 3 remain above the printing substrate 7 on the front cap rack 4.1.

In FIG. 14 two pins 14 are drawn per protective cap bar 3, for example, which pins 14 can engage into associated bores of the print bars in order to connect these with one another.

A large advantage of the method according to the preferred embodiment exists in that the printing unit 2 is executed such that each print bar 1 can be operated individually:

The printing unit 2 can be in the park position, wherein the print bars 1 can be sealed by their protective cap bars 3 or be decoupled from their protective cap bars 3.

In the printing unit 2 the print bars 1, with or without protective cap bars 3, can be moved from the transport position into the park position and back.

In the printing unit 2 the print bars 1 can be in the print position, i.e. situated over the printing substrate 7 without protective cap bar 3.

In the printing unit 2 the print bars 1 can be in the transport position, in which they have been moved upward from the print position in their drive and guidance unit 5.

In the printing unit 2 the print bars 1 can be in the transport position, in which they have been moved upward from the print position in their drive and guidance unit 5 and are covered by their protective cap bars 3.

All print bars 1 can likewise be operated correspondingly, together with or separately from one another. The protective cap bars 3 can additionally be borne on the front cap bar 4.1 on the transport unit 8, and the printing unit can be brought into a service position in which the print heads are freely accessible.

In the explanation of the print group according to the preferred embodiment, its construction design—in particular of the printing unit 2—has not been discussed in detail. For example, the drive and guidance units 5, 6 can be of known design; for example, they can have a step motor that moves the print bars 1 or the printing unit 2 on the guidance units 5 or 6. In the Drawing Figures the transport unit 8 is configured so that the printing substrate 7 is directed past the printing unit 2 in a straight line (FIG. 4). However, it is also possible to feed the printing substrate 7 past the printing unit 2 in an arc. The print bars 1 can then be arranged in a star shape in the printing unit 2. Since the print bars 1 can be moved independently of one another by their drive and guidance units 5, in this case the desired clearance between the respective print bars 1 and the printing substrate 7 can also be set. The printing substrate 7 is presented in the form of webs in the Drawing Figures. The printing substrate can also comprise individual sheets.

Although a preferred exemplary embodiment is shown and described in detail in the drawings and in the preceding specification, it should be viewed as purely exemplary and not as limiting the invention. It is noted that only a preferred exemplary embodiment is shown and described, and all variations and modifications that presently or in the future lie within the protective scope of the invention should be protected.

We claim:

1. A method to position print bars having print heads and respective protective cap bars provided to cover the associated print bars, said print bars being provided in a moveable printing unit, comprising the steps of:

providing the respective protective cap bars such that they can be releasably coupled to their associated print bars;

providing the print bars such that they can be moved independently of one another in said printing unit between a printing position in which a printing substrate can be printed and a transport position above the printing position;

moving said printing unit with said print bars from an operating position overlying a printing location of said printing substrate to a park position not overlying said printing location of said printing substrate;

with said printing unit in said operating position, printing said substrate at said printing location with print bars in said printing position and with said associated protective caps not coupled thereto, and for print bars in said transport position and which are not printing on said printing substrate providing the respective protective cap bars coupled to said associated print bars in said transport position; and locating in said park position the respective protective cap bars for those printing bars which are in said printing position.

2. The method according to claim 1 wherein said protective cap bars not coupled to their associated print bars and located in said park position resting on a cap rack in said park position.

3. The method according to claim 1 wherein when said printing unit is moved from said operating position to said park position none of said print bars are printing to said printing substrate.

4. The method according to claim 1 wherein when said printing unit is moved from said operating position to said park position for servicing of print bars, for print bars being serviced, the respective protective cap bars for said print bars being serviced are located at said operating position.

5. The method of claim 4 wherein said respective protective cap bars located at said operating position resting on a cap rack above said printing substrate.

6. The method of claim 1 wherein said park position is perpendicular to a moving direction of the printing substrate.

7. A method to position print bars having print heads and respective protective cap bars provided to cover the associated print bars, said print bars being provided in a moveable printing unit, comprising the steps of:

providing the respective protective cap bars such that they can be releasably coupled to their associated print bars;

providing the print bars such that they can be moved independently of one another in said printing unit between a printing position in which a printing substrate can be printed and a transport position above the printing position;

moving said printing unit with said print bars from an operating position overlying a printing location of said printing substrate to a park position not overlying said printing location of said printing substrate; and with said printing unit in said operating position, printing said substrate at said printing location with print bars in said printing position and with said associated protective caps not coupled thereto, and for print bars in said transport position and which are not printing on said printing substrate providing the respective protective cap bars coupled to said associated print bars in said transport position.

* * * * *